US009188378B2

(12) United States Patent
Maples

(10) Patent No.: US 9,188,378 B2
(45) Date of Patent: Nov. 17, 2015

(54) SYSTEMS AND METHODS FOR PROVIDING AN ICE STORAGE BIN CONTROL SENSOR AND HOUSING

(75) Inventor: Gregory J. Maples, Senoia, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 1357 days.

(21) Appl. No.: 11/931,902

(22) Filed: Oct. 31, 2007

(65) Prior Publication Data

US 2008/0110186 A1 May 15, 2008

Related U.S. Application Data

(60) Provisional application No. 60/855,555, filed on Oct. 31, 2006.

(51) Int. Cl.
*F25C 5/18* (2006.01)

(52) U.S. Cl.
CPC ..... *F25C 5/187* (2013.01); *F25C 2500/02* (2013.01)

(58) Field of Classification Search
CPC .. F25C 5/187; F25C 2500/02; F25C 2700/00; F25C 2301/00; F25C 2700/02
USPC ..... 62/137, 344; 340/617
See application file for complete search history.

(56) References Cited

U.S. PATENT DOCUMENTS

| | | | | |
|---|---|---|---|---|
| 3,831,159 | A * | 8/1974 | Parsons | 340/617 |
| 3,885,400 | A | 5/1975 | Webb | |
| 3,911,691 | A | 10/1975 | Kohl et al. | |
| 4,662,182 | A * | 5/1987 | Tsukiyama et al. | 62/137 |
| 4,822,996 | A | 4/1989 | Lind | |
| 4,966,008 | A | 10/1990 | Yoshida et al. | |
| 4,993,232 | A * | 2/1991 | Tatematsu et al. | 62/137 |
| 5,060,484 | A | 10/1991 | Bush et al. | |
| 5,131,234 | A | 7/1992 | Furukawa et al. | |
| 6,192,693 | B1 * | 2/2001 | Kloppenberg et al. | 62/137 |
| 6,418,736 | B1 * | 7/2002 | Cover | 62/137 |

* cited by examiner

*Primary Examiner* — Mohammad M Ali
(74) *Attorney, Agent, or Firm* — Sutherland Asbill & Brennan LLP

(57) ABSTRACT

Embodiments of the invention can provide an ice storage bin control sensor and housing. In one embodiment, an ice storage bin can be provided. The ice storage bin can include at least one wall, an ice control sensor, and a housing section. The housing section can include an inner wall component operable to support at least a portion of the ice control sensor. The housing section can also include an outer wall component operable to support at least a portion of the ice control sensor. In addition, the housing section can include a cavity operable to receive the ice control sensor. Furthermore, the housing section can include a stop portion operable to maintain the position of the outer wall component or the inner wall component relative to the at least one wall of the ice storage bin, wherein at least a portion of the inner wall component is angled with respect to the stop portion, and at least a portion of the ice control sensor can be maintained at a predefined angle to the at least one wall within the ice storage bin.

22 Claims, 5 Drawing Sheets

SYSTEMS AND METHODS FOR PROVIDING AN ICE STORAGE BIN CONTROL SENSOR AND HOUSING

RELATED APPLICATION

This application claims priority to U.S. Provisional Application Ser. No. 60/855,555 filed on Oct. 31, 2006, the contents of which are incorporated by reference.

FIELD OF THE INVENTION

The invention generally relates to ice machines, and more particularly relates to systems and methods for providing an ice storage bin control sensor and housing.

BACKGROUND OF THE INVENTION

Ice has long been used for various commercial and domestic demands. In the domestic context, ice makers are typically located in a freezer portion of a refrigerator. In the commercial context, large quantities of ice can be made by an ice machine for storage in a bin.

In both the commercial and domestic context, there is typically a machine or component, such as an ice machine, that produces ice, and a bin that collects and stores the ice that the machine or component produces. The ice machine or component can continuously produce ice until it receives a signal or is otherwise instructed to stop producing ice. In some instances, the ice machine or component can receive the signal from some type of sensor that detects the level of ice in the bin.

There are many types of conventional ice level-detecting sensors. One general category includes a sensor that can detect the level of ice by a mechanical means, for example, as shown in some or all of U.S. Pat. Nos. 3,885,400; 3,911,691; 4,662,182; 4,966,008; and 4,993,232. In general, this type of sensor can include an element that rotates or otherwise moves when the ice exceeds a certain level, and the movement generates a signal transmitted to the ice machine to stop making ice.

There are other types of conventional level-detecting sensors. For example, U.S. Pat. No. 5,131,234 relates to a temperature sensor; U.S. Pat. No. 5,060,484 relates to an ultrasonic sensor; and U.S. Pat. No. 4,822,996 relates to a photodetector sensor.

One problem with conventional sensors and sensing-type devices is that condensation can collect on the sensor, thus prohibiting or otherwise inhibiting the sensor from signaling the ice machine to cease ice production. When ice production is not regulated, the ice bin can overflow and ice can be wasted. For example, in the sensor shown in U.S. Pat. No. 4,822,996, condensation can form on the lens of the light source, which could prohibit or otherwise inhibit the light source from emitting light. Another problem is that melted water can drip into the sensor and cause an electrical malfunction. Furthermore, many conventional sensors, particularly thermostat and some mechanical-type sensors, can be unreliable. For instance, U.S. Pat. No. 5,131,234 relates to an ice level-detecting apparatus for ice-making machines and more particularly to a holder assembly for holding the temperature sensor element of a thermostat of an ice level-detecting apparatus. In particular, thermostat-type sensors can erroneously detect levels because thermostats may respond to cold air during the ice making operation cycle, or to cold radiation emitted from ice stored in an associated ice storage bin. Such responses to indicia unrelated to the level within the ice bin can make these types of conventional sensors unreliable.

Moreover, many conventional sensors are difficult to install and/or remove from an ice storage bin or ice machine, thereby increasing maintenance and repair costs.

Thus, a need exists for systems and methods for providing an ice storage bin control sensor and housing.

SUMMARY OF THE INVENTION

Embodiments of the invention can provide systems and methods for providing an ice storage bin control sensor and housing. In one embodiment, the invention can include an ice machine with a sensor to detect the level of ice in an associated ice storage bin. The sensor can be mounted inside or adjacent to the ice storage bin that stores ice or other small particles, and an associated sensor housing can protect the sensor from contaminants and damage.

In one embodiment, the sensor can include a housing to position a level-detecting sensor at a predefined angle with respect to an ice storage bin. The sensor is capable of sensing ice and the level of ice within the ice storage bin. At a predetermined level, such as when the ice storage bin is detected to be full, the sensor can send a signal or instruction to delay further ice production or otherwise shut down an associated ice-making machine or component. The configuration and location of the housing can minimize and reduce the amount of condensation and excess water that could drip onto or otherwise form on the sensor, particularly the sensor eye or detecting element. This improvement can decrease the possibility of a sensor malfunction or false measurement.

Embodiments of a sensor and housing can mount adjacent to a lower portion of an ice machine. A sensor and housing in accordance with embodiments of the invention can be easily installed, and can be removable from the ice machine and/or ice storage bin with minimal use of associated tools for cleaning, repair, or maintenance of the sensor and/or housing.

In one embodiment, an apparatus for housing an ice control sensor associated with an ice storage bin can be provided. The apparatus can include a body section. The body section can include an inner wall component operable to support at least a portion of the ice control sensor. The body section can also include an outer wall component operable to support at least a portion of the ice control sensor. In addition, the body section can include a cavity operable to receive the ice control sensor. Furthermore, the body section can include a stop portion operable to maintain the position of the outer wall component or the inner wall component relative to at least one wall of the ice storage bin, wherein at least a portion of the inner wall component is angled with respect to the stop portion.

In one embodiment, a system for providing ice control for an ice storage bin can be provided. The system can include an ice control sensor and a housing. The housing can include an inner wall component operable to support at least a portion of the ice control sensor. The housing can also include an outer wall component operable to support at least a portion of the ice control sensor. In addition, the housing can include a cavity operable to receive the ice control sensor. Furthermore, the housing can include a stop portion operable to maintain the position of the outer wall component or the inner wall component relative to at least one wall of the ice storage bin, wherein at least a portion of the inner wall component is angled with respect to the stop portion, and at least a portion of the ice control sensor can be maintained at a predefined angle within the ice storage bin.

In one embodiment, an ice storage bin can be provided. The ice storage bin can include at least one wall, an ice control sensor, and a housing section. The housing section can include an inner wall component operable to support at least a portion of the ice control sensor. The housing section can also include an outer wall component operable to support at least a portion of the ice control sensor. In addition, the housing section can include a cavity operable to receive the ice control sensor. Furthermore, the housing section can include a stop portion operable to maintain the position of the outer wall component or the inner wall component relative to the at least one wall of the ice storage bin, wherein at least a portion of the inner wall component is angled with respect to the stop portion, and at least a portion of the ice control sensor can be maintained at a predefined angle to the at least one wall within the ice storage bin.

In one embodiment, a method for providing an ice control sensor and housing for an ice storage bin can be provided. The method can include mounting a sensor housing to at least one wall of the ice storage bin. The sensor housing can include an inner wall component operable to support at least a portion of the ice control sensor. The sensor housing can also include an outer wall component operable to support at least a portion of the ice control sensor. In addition, the sensor housing can include a cavity operable to receive the ice control sensor. Furthermore, the sensor housing can include a stop portion operable to maintain the position of the outer wall component or the inner wall component relative to at least one wall of the ice storage bin, wherein at least a portion of the inner wall component is angled with respect to the stop portion. The method can also include mounting the ice control sensor within the cavity associated with the sensor housing.

In one embodiment, a system for sensing ice and the level of ice within an ice storage bin can be provided. The system can include an ice control sensor. The system can also include a sensor housing operable to mount to at least one wall of the ice storage bin. The sensor housing can include an inner wall component operable to support at least a portion of the ice control sensor. In addition, the sensor housing can include an outer wall component operable to support at least a portion of the ice control sensor. Furthermore, the sensor housing can include a cavity operable to receive the ice control sensor. Moreover, the sensor housing can include a stop portion operable to maintain the position of the outer wall component or the inner wall component relative to at least one wall of the ice storage bin, wherein at least a portion of the inner wall component is angled with respect to the stop portion. The system can also include a processor operable to receive at least one signal from the ice control sensor, wherein based at least in part on the signal, the processor can either delay or continue ice production from an associated ice making component associated with the ice storage bin.

BRIEF DESCRIPTION OF THE DRAWINGS

These and other aspects, features, and advantages of the invention are better understood when the following Detailed Description is read with reference to the accompanying drawings, wherein.

DETAILED DESCRIPTION OF EMBODIMENTS

Figure 1:
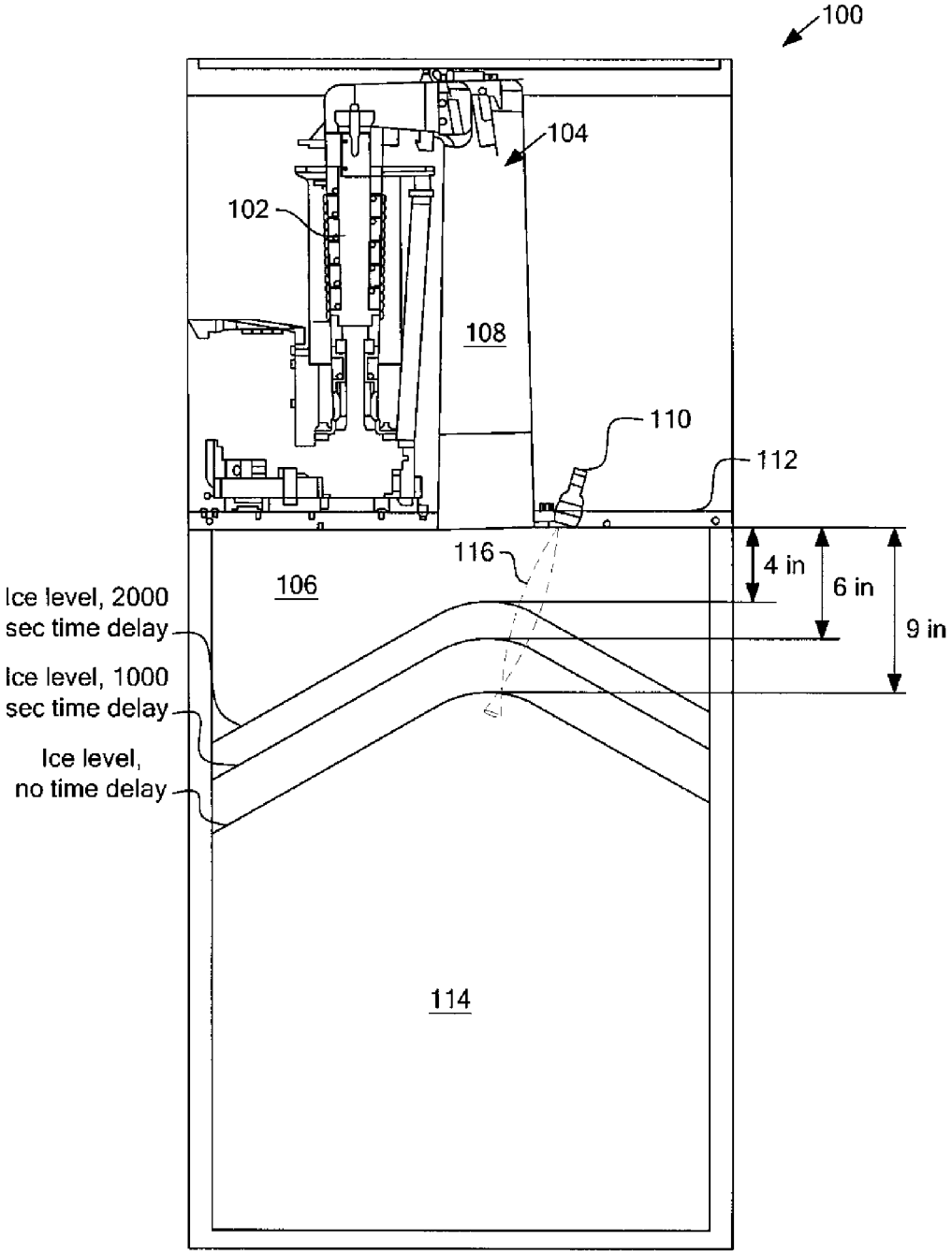
FIG. 1 shows an ice machine with a level-detecting sensor and housing in accordance with an embodiment of the invention.

FIG. 1 illustrates an example ice machine with a level-detecting sensor and housing in accordance with an embodiment of the invention. The ice machine 100 shown can include an ice making section 102, an ice discharge port 104, an ice storage section 106, an ice delivery chute 108, and an ice storage level-detecting apparatus 110 comprising an ice storage level-detecting sensor and associated housing. In other embodiments, an ice machine can have other components including, but not limited to, a sliding access door, an ice probe access port, and an internal baffle. The above example is not intended to be limiting, and an ice storage level-detecting apparatus can be implemented with a variety of other ice production equipment, components, and ice storage bins.

In the example shown, the ice making section 102 can be a conventional machine or component that makes ice. The ice discharge port 104 receives ice from the ice making section 102, and the ice can be transferred via the ice delivery chute 108 to the ice storage section 106. The ice delivery chute 108 provides ice transfer capability from the ice discharge port 104 to the ice storage section 106. In this example, the ice travels downward from the ice discharge port 104 through the ice delivery chute 108, and into the ice storage section 106. The ice storage section 106 stores ice temporarily or longer until needed.

Figure 2:
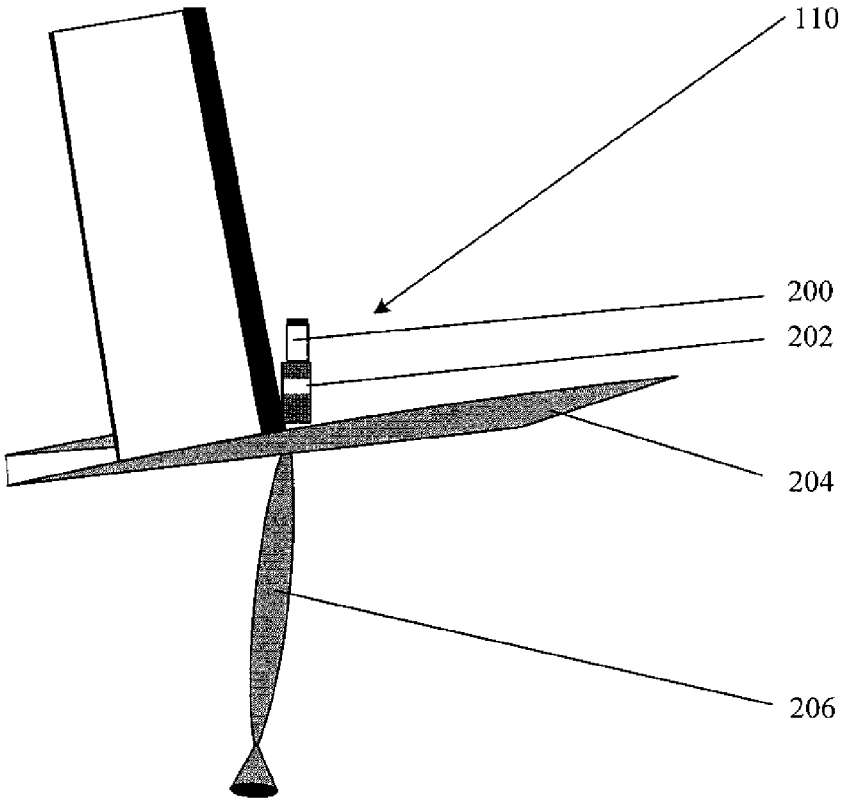
FIG. 2 shows a perspective view of a level-detecting sensor and housing for an ice machine in accordance with an embodiment of the invention.

The ice storage level-detecting apparatus 110 can include a level-detecting sensor and associated housing, examples of which are respectively shown as 200 and 202 in FIG. 2. As shown in FIG. 1, the ice storage level-detecting apparatus 110 can be positioned within the ice machine 100 and adjacent to the ice storage section 106. Typically, the ice storage level-detecting apparatus 110 can be mounted to a wall, panel, or other surface associated with the ice machine 100. For example, the ice storage level-detecting apparatus 110 shown is mounted to an upper, internal wall 112 of the ice machine above the ice storage section 106. In particular, the ice storage level-detecting apparatus 110 is positioned at an angle relative to the internal wall 112, and directed towards ice 114 within the ice storage section 106. The ice storage level-detecting apparatus 110 is configured to detect the ice 114 within the ice storage section 106, or otherwise detect the level of ice 114 within the ice storage section 106 of the ice machine 100.

A detection area 116 for the ice storage level-detecting apparatus 110 is illustrated in FIG. 1. The detection area 116 is shown by way of example, and can be larger or smaller, or may have a different shape depending on the type of sensor or sensor technology used with the ice storage level-detecting apparatus 110. Turning to the example of FIG. 2, the ice storage level-detecting apparatus 110 includes a level-detecting sensor 200 and associated housing 202. The sensor 200 is capable of detecting a level of ice, such as 114 in FIG. 1, within an ice storage section, such as 106, or within an ice storage bin adjacent to the sensor 200. The sensor 200 shown can be an infrared-type sensor. Other types of sensors can be implemented with embodiments of an ice storage level-detecting apparatus 110. Suitable technologies for a sensor 200 can include, but are not limited to, infrared, photo detection, and other types of motion or temperature detection-based technologies.

The housing 202 can receive the sensor 200 and mount the sensor 200 to a surface of a wall 204 associated with the ice machine, such as 100. In the example shown, the housing 202 can mount to a location adjacent to the ice storage section 1006 or an ice storage bin, such as a lower portion, wall 204, or panel of the ice making section, such as 102, or ice discharge port 104 adjacent to the ice storage section 106 in FIG. 1. The housing 202 shown can be generally cylindrically-shaped and can mount at a predetermined angle with respect to an associated wall 204, portion, or panel of the ice storage section 106 or other component. An example of a housing is shown and described below with respect to FIG. 5. The housing 202 is capable of minimizing or otherwise reducing the amount of condensation and excess water that may drip onto or otherwise form on the sensor 200. Other shapes, configurations, angles, and locations for a sensor and housing can exist in accordance with other embodiments of the invention.

A detection area 206 for the sensor 200 is illustrated in FIG. 2. The detection area 206 is shown by way of example, and can be larger or smaller, or may have a different shape depending on the type of sensor or sensor technology used.

Figure 3:
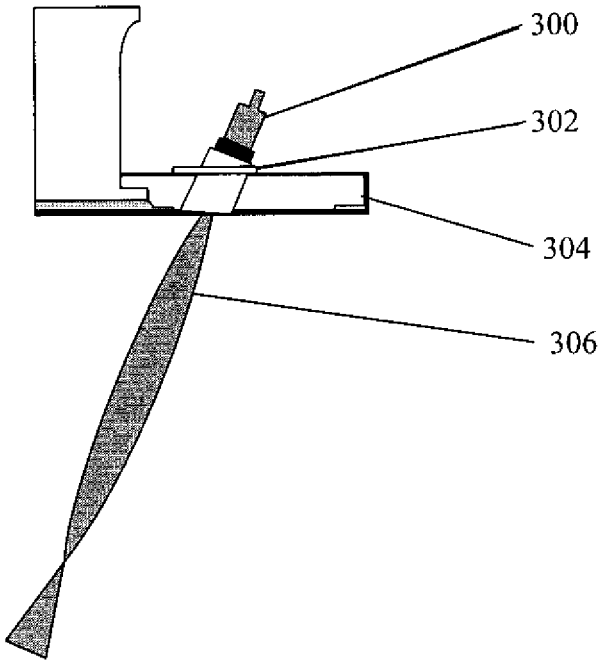
FIG. 3 shows a side view of a level-detecting sensor and housing for an ice machine in accordance with an embodiment of the invention.

FIG. 3 is a side view of a level-detecting sensor and housing in accordance with an embodiment of the invention. The level-detecting sensor 300 and housing 302 shown in FIG. 3 are similar to the level-detecting sensor 200 and housing 202 shown in FIG. 2, and are shown oriented at a different angle relative to a mounting wall 304 or panel than the apparatus in FIG. 2. Furthermore, a detection area 306 for the sensor 300 is shown, and is similar in shape to the detection area 206 shown in FIG. 2. Various embodiments of a level-detecting sensor and housing in accordance with the invention can be positioned at different angles relative to an associated mounting wall or panel depending on where ice is within an associated ice storage section or ice storage bin. In addition, further embodiments can have a detection area for a sensor which can be larger or smaller, or may have a different shape depending on the type of sensor or sensor technology used.

A detection area 306 for the sensor 300 is illustrated in FIG. 3. The detection area 306 is shown by way of example, and can be larger or smaller, or may have a different shape depending on the type of sensor or sensor technology used.

Figure 4:
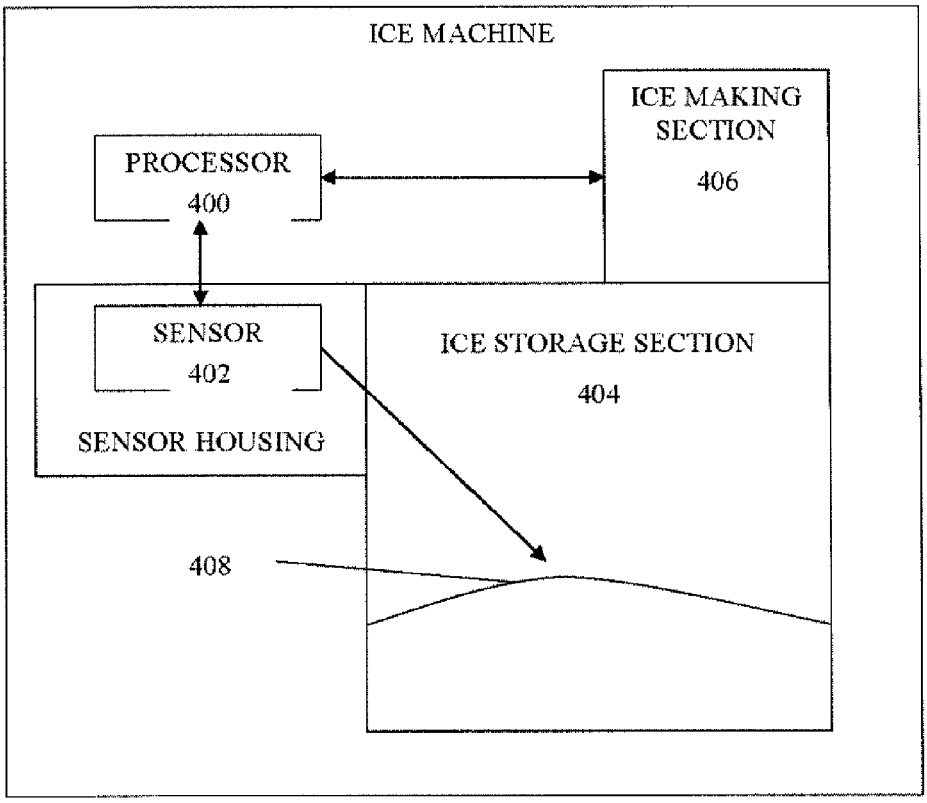
FIG. 4 shows a schematic for a processor, level-detecting sensor, and housing for an ice machine in accordance with an embodiment of the invention.

In one embodiment, a sensor such as 200 can be in communication with a processor associated with an ice machine, such as 100 in FIG. 1. An example arrangement of a sensor and processor for an ice machine is shown in FIG. 4. The processor 400 in FIG. 4 can be programmed or can otherwise contain instructions to provide a user or operator with the ability to control, monitor, or otherwise define the sensitivity of the sensor 402 to detect ice within an ice storage section 404, or an ice storage bin. Furthermore, the processor 400 can be programmed to implement a time delay in further ice production or otherwise shut down an ice making section 406 or another component when the sensor 402 detects a certain ice level 408 within the ice storage section 404. For example, a processor can be programmed to detect a signal from the sensor that indicates that an ice storage section is relatively full when the ice level within the ice storage section reaches a level of approximately 4.0 inches from the sensor. In this example, the processor can implement a time delay of approximately 2000 seconds, which delays further ice production from the ice making section, or otherwise delays further introduction of ice into the ice storage section. By way of further example, a processor can be programmed to detect a signal from the sensor that indicates that an ice storage section is nearly full when the ice level within the ice storage section reaches a level approximately 6.0 inches from the sensor. In this example, the processor can implement a time delay of approximately 1000 seconds, which delays further ice production from the ice making section, or otherwise delays further introduction of ice into the ice storage section. The processor can also be programmed to detect a signal from the sensor that indicates that an ice storage section is not yet full when the ice level within the ice storage section reaches a level of approximately 9.0 inches from the sensor. In this example, the processor does not implement any time delay, and continues ice production from the ice making section into the ice storage section. FIG. 1 illustrates example ice levels in the ice storage section 106, and predetermined time delays for a processor associated with the ice storage level-detecting apparatus 110.

In another embodiment, a processor can be programmed to implement a variety of other time delays in further ice production or can otherwise shut down the ice making section 102 or another component when the sensor detects other predetermined ice levels within the ice storage section 106. Depending on the sensor technology used with a particular embodiment of the invention, a processor can be programmed to receive a signal from the sensor indicating a relative level of ice within an ice storage section, such as 106 in FIG. 1, and the processor can control further ice production or can otherwise shut down the ice making section 102 or another component.

Figure 5:
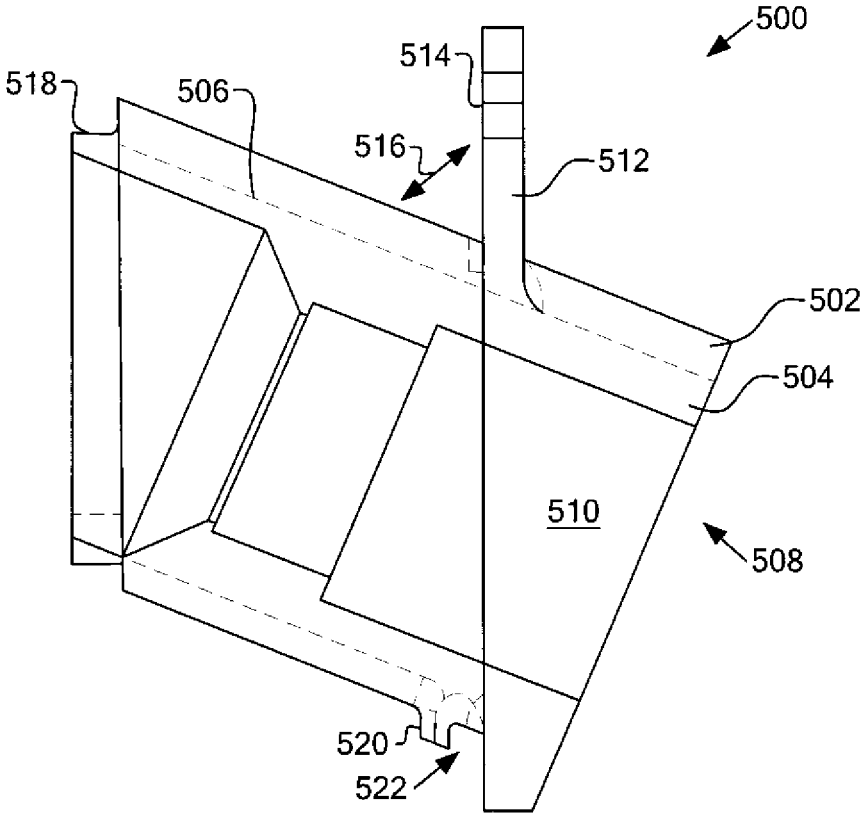
FIG. 5 shows a side view of a housing for a level-detecting sensor in accordance with an embodiment of the invention.

FIG. 5 shows a side view of an example housing for an ice storage level-detecting apparatus, such as 110 in FIG. 1. The housing 500 is generally cylindrically-shaped, and can include a body section 502 with an outer wall component 504, an inner wall component 506, and an internal mounting component 508. The outer wall component 504 and the inner wall component 506 are shown integrally mounted together to form the body section 502, and the internal mounting component 508 includes a cavity 510 machined or otherwise formed through both the outer wall component 504 and the inner wall component 506. The cavity 510 is sized to receive a sensor, such as shown and described as 200 and 300 in FIGS. 2 and 3 above. In one embodiment, the cavity 510 can include a series of threads sized to receive corresponding threads on an external surface of a sensor. In another embodiment, the cavity 510 can include a series of internal surfaces which correspond with the external surfaces of a sensor. The housing 500 is further shaped to mount through and adjacent to a corresponding hole in a surface, wall, or panel associated with an ice machine, such as wall 112 shown in FIG. 1.

The outer wall component 504 includes a stop portion 512 capable of maintaining the position of the housing 500 relative to a surface, wall, or panel associated with an ice machine, such as wall 112. In this embodiment, the stop portion 512 includes a relatively flat portion 514 capable of mounting adjacent to a surface, wall, or panel associated with an ice machine, such as wall 112. When the housing 500 is inserted within a hole in a wall of an ice machine, such as wall 112, the stop portion 512 can permit a portion of the outer wall component 504 to protrude from the hole away from the wall 112.

As shown in the example of FIG. 5, the body section 502 is oriented at an angle 516 with respect to the stop portion 512. The angle 516 of the body section 502 permits the housing to mount to the wall 112 at a corresponding angle. The outer wall component 504 and the inner wall component 506 have similarly shaped external walls angled with respect to the stop portion 512 of the outer wall component 504. When the housing 500 is inserted within the hole in the wall 112, the inner wall component 506 protrudes through the hole and into a portion of the ice machine, such as the ice making section 102 in FIG. 1. The angle 516 of the body section 502 permits the internal mounting component 508 to mount at an angle relative to the wall 112. The angle 516 of the body section 502 can inhibit or otherwise reduce the formation of condensation on a sensor mounted to or within the cavity 510 of the internal mounting component 508. In the embodiment shown, the angle 516 can be between approximately 15 degrees and approximately 75 degrees. In other embodiments, a suitable angle, such as 516, can be between about 1 degree and 89 degrees.

When the housing 500 is fully inserted into the hole of the wall 112, an extension 518 of the inner wall component 506 can extend into the ice machine and protect a portion of the sensor mounted within the cavity 510 of the internal mounting component 508. The extension 518 also provides the housing 500 with additional support to maintain the housing 500 within the hole and relative to the wall 112 of the ice machine 100.

In addition, a protrusion 520 from an external surface of the inner wall component 506 can assist in the positioning and mounting of the housing 500 relative to a wall, such as 112, of the ice machine, such as 100. As shown in FIG. 5, the protrusion 520 can extend away from the inner wall component 506, and a gap 522 between the protrusion 520 and the relatively flat portion 514 can receive a portion of the wall, such as 112, that the housing 500 mounts to. In other embodiments, other shapes, configurations, and devices for a protrusion can exist.

In one embodiment, the housing 500 can be fit snugly into a corresponding hole in the wall of the ice machine, such as 112 shown in FIG. 1. In another embodiment, associated mounting devices, such as screws, bolts, or adhesive, can be used to secure the housing 500 with respect to a corresponding hole in the wall of the ice machine, such as 112 shown in FIG. 1. In any instance, the housing 500 can be removed, adjusted, and mounted with respect to the ice machine with minimal use of any tools.

Other examples of a housing in accordance with other embodiments of the invention can include similar or different components, and can have other shapes, sizes, and configurations. Those skilled in the art will recognize that the example housings shown in FIGS. 1-5 illustrate particular implementations of the invention, and that other embodiments of the invention can exist.

It will be recognized by those skilled in the art that changes may be made in the above described embodiments of the invention without departing from the concepts thereof. The invention is not limited to the particular embodiments disclosed, but is intended to cover all modifications that are within the scope of the invention.

The claimed invention is:

1. An apparatus for housing an electronic ice control sensor associated with an ice storage bin, the apparatus comprising:

a body section comprising:

an inner wall component operable to support at least a portion of the electronic ice control sensor;

an outer wall component operable to support at least a portion of the electronic ice control sensor, wherein the inner wall component and the outer wall component are mounted to each other;

a cavity operable to receive the electronic ice control sensor, wherein the cavity is formed through both the inner wall component and the outer wall component; and a stop portion operable to maintain the position of the outer wall component or the inner wall component relative to at least one wall of the ice storage bin;

wherein at least a portion of the inner wall component is angled with respect to the stop portion, and when the electronic ice control sensor is positioned in the cavity, the electronic ice control sensor is maintained by the inner wall component and outer wall component at an angled position relative to the at least one wall of the ice storage bin, the angled position protecting the electronic ice control sensor from the formation of condensation on the electronic ice control sensor, and wherein the inner wall component protrudes into the associated ice storage bin protecting the electronic ice control sensor from excess condensation or water that can drip onto the electronic ice control sensor from the ice storage bin.

2. The apparatus of claim 1, wherein the cavity comprises at least one wall component comprising one or more internal threads to receive corresponding external threads associated with the electronic ice control sensor.

3. The apparatus of claim 1, wherein the electronic ice control sensor comprises at least one of the following: a level detecting sensor, an ice detection sensor, an infrared-type sensor, a photodetection-type sensor, a motion sensor, or a temperature sensor.

4. The apparatus of claim 1, wherein the angle of the inner wall component with respect to the stop portion is between approximately 15 degrees and approximately 75 degrees.

5. The apparatus of claim 1, wherein the body section further comprises:

an extension associated with the inner wall component, wherein the extension is operable to protect a portion of the electronic ice control sensor when the sensor is mounted within the cavity.

6. The apparatus of claim 1, wherein the body section further comprises:

a protrusion associated with the inner wall component, wherein the protrusion is operable to cooperate with the stop portion to maintain the position of the inner wall component or outer wall component relative to at least one wall of the ice storage bin.

7. A system for providing ice control for an ice storage bin, the system comprising:

an electronic ice control sensor; and a housing section comprising:

an inner wall component operable to support at least a portion of the electronic ice control sensor;

an outer wall component operable to support at least a portion of the electronic ice control sensor, wherein the inner wall component and the outer wall component are mounted to each other;

a cavity operable to receive the electronic ice control sensor, wherein the cavity is formed through both the inner wall component and the outer wall component; and a stop portion operable to maintain the position of the outer wall component or the inner wall component relative to at least one wall of the ice storage bin;

wherein at least a portion of the inner wall component is angled with respect to the stop portion, and when the electronic ice control sensor is positioned in the cavity, the electronic ice control sensor is maintained by the inner wall component and outer wall component at an angled position relative to the at least one wall of the ice storage bin, the angled position protecting the electronic ice control sensor from the formation of condensation on the electronic ice control sensor, and wherein the inner wall component protrudes into the associated ice storage bin protecting the electronic ice control sensor from excess condensation or water that can drip onto the electronic ice control sensor from the ice storage bin.

8. The system of claim 7, wherein the cavity comprises at least one wall component comprising one or more internal threads to receive corresponding external threads associated with the electronic ice control sensor.

9. The system of claim 7, wherein the electronic ice control sensor comprises at least one of the following: a level detecting sensor, an ice detection sensor, an infrared-type sensor, a photodetection-type sensor, a motion sensor, or a temperature sensor.

10. The system of claim 7, wherein the angle of the inner wall component with respect to the stop portion is between approximately 15 degrees and approximately 75 degrees.

11. The system of claim 7, wherein the body section further comprises:

an extension associated with the inner wall component, wherein the extension is operable to protect a portion of the electronic ice control sensor when the sensor is mounted within the cavity.

12. The system of claim 7, wherein the body section further comprises:

a protrusion associated with the inner wall component, wherein the protrusion is operable to cooperate with the stop portion to maintain the position of the inner wall component or outer wall component relative to at least one wall of the ice storage bin.

13. An ice storage bin comprising:

at least one wall;

an ice control sensor; and a housing section comprising:

an inner wall component operable to support at least a portion of the ice control sensor;

an outer wall component operable to support at least a portion of the ice control sensor, wherein the inner wall component and the outer wall component are mounted to each other;

a cavity operable to receive the ice control sensor, wherein the cavity is formed through both the inner wall component and the outer wall component; and a stop portion operable to maintain the position of the outer wall component or the inner wall component relative to the at least one wall of the ice storage bin;

wherein at least a portion of the inner wall component is angled with respect to the stop portion, and when the electronic ice control sensor is positioned in the cavity, the electronic ice control sensor is maintained by the inner wall component and outer wall component at an angled position relative to the at least one wall of the ice storage bin, the angled position protecting the electronic ice control sensor from the formation of condensation on the electronic ice control sensor, and wherein the inner wall component protrudes into the associated ice storage bin protecting the electronic ice control sensor from excess condensation or water that can drip onto the electronic ice control sensor from the ice storage bin.

14. The ice storage bin of claim 13, wherein the cavity comprises at least one wall component comprising one or more internal threads to receive corresponding external threads associated with the ice control sensor.

15. The ice storage bin of claim 13, wherein the ice control sensor comprises at least one of the following: a level detecting sensor, an ice detection sensor, an infrared-type sensor, a photodetection-type sensor, a motion sensor, or a temperature sensor.

16. The ice storage bin of claim 13, wherein the angle of the inner wall component with respect to the stop portion is between approximately 15 degrees and approximately 75 degrees.

17. The ice storage bin of claim 13, wherein the body section further comprises:

an extension associated with the inner wall component, wherein the extension is operable to protect a portion of the ice control sensor when the sensor is mounted within the cavity.

18. The ice storage bin of claim 13, wherein the body section further comprises:

a protrusion associated with the inner wall component, wherein the protrusion is operable to cooperate with the stop portion to maintain the position of the inner wall component or outer wall component relative to at least one wall of the ice storage bin.

19. A method for providing an ice control sensor and housing for an ice storage bin, the method comprising:

mounting a sensor housing to at least one wall of the ice storage bin, the sensor housing comprising:

an inner wall component operable to support at least a portion of the ice control sensor, wherein the inner wall component and the outer wall component are mounted to each other;

an outer wall component operable to support at least a portion of the ice control sensor;

a cavity operable to receive the ice control sensor, wherein the cavity is formed through both the inner wall component and the outer wall component; and a stop portion operable to maintain the position of the outer wall component or the inner wall component relative to at least one wall of the ice storage bin;

wherein at least a portion of the inner wall component is angled with respect to the stop portion; and mounting the ice control sensor within the cavity associated with the sensor housing, wherein the ice control sensor is maintained by the inner wall component and outer wall component at an angled position relative to the at least one wall of the ice storage bin, the angled position protecting the electronic ice control sensor from the formation of condensation on the electronic ice control sensor, and wherein the inner wall component protrudes into the associated ice storage bin protecting the electronic ice control sensor from excess condensation or water that can drip onto the electronic ice control sensor from the ice storage bin.

20. The method of claim 19, wherein mounting the ice control sensor within the cavity associated with the sensor housing comprises interlocking one or more internal threads to receive corresponding external threads associated with the ice control sensor.

21. The method of claim 19, wherein the ice control sensor comprises at least one of the following: a level detecting sensor, an ice detection sensor, an infrared-type sensor, a photodetection-type sensor, a motion sensor, or a temperature sensor.

22. The method of claim 19, wherein the angle of the inner wall component with respect to the stop portion is between approximately 15 degrees and approximately 75 degrees.

* * * * *